United States Patent [19]

Yangas

[11] Patent Number: 4,771,155

[45] Date of Patent: Sep. 13, 1988

[54] APPARATUS FOR PROMOTING THE UNIFORM HEATING OF A FOOD PRODUCT IN A RADIANT ENERGY FIELD

[76] Inventor: Roger A. Yangas, 14000 Citation Dr., Orland Park, Ill. 60642

[21] Appl. No.: 19,216

[22] Filed: Feb. 26, 1987

Related U.S. Application Data

[63] Continuation-in-part of Ser. No. 765,374, Aug. 14, 1985, Pat. No. 4,683,362.

[51] Int. Cl.[4] ..... H05B 6/64

[52] U.S. Cl. ..... 219/10.55 F; 219/10.55 E; 99/DIG. 14; 426/243

[58] Field of Search ..... 219/10.55 F, 10.55 E, 219/10.55 M, 10.55 R, 339, 341, 342, 346, 347, 348, 349; 426/234, 241, 243; 99/DIG. 14, 451

[56] References Cited

U.S. PATENT DOCUMENTS

| | | | |
|---|---|---|---|
| 3,316,380 | 4/1967 | Pansing | 219/10.55 F |
| 3,461,260 | 8/1969 | Bremer | 219/10.55 F |
| 4,144,435 | 3/1979 | Clark et al. | 219/10.55 E |
| 4,144,438 | 3/1979 | Gelman et al. | 219/10.55 E |
| 4,228,334 | 10/1980 | Clark et al. | 219/10.55 E |
| 4,539,454 | 9/1985 | Yangas | 219/10.55 F |
| 4,683,362 | 7/1987 | Yangas | 219/10.55 F |

*Primary Examiner*—Philip H. Leung

*Attorney, Agent, or Firm*—Silverman, Cass, Singer & Winburn, Ltd.

[57] ABSTRACT

An apparatus for uniformly heating a product in the presence of a radiant energy heating source includes a plurality of radiant energy reflective collectors encased in a radiant energy transparent material. The collectors are formed by a number of tabs that collect the radiant energy incident on the collectors and form a radiant energy field such that a food product is heated to a uniform temperature throughout.

28 Claims, 4 Drawing Sheets

FIG. 1
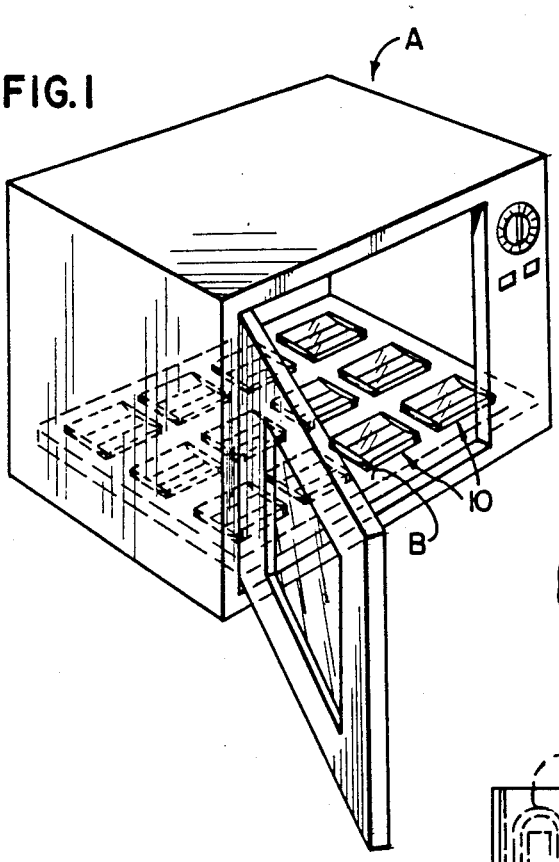
FIG. 2
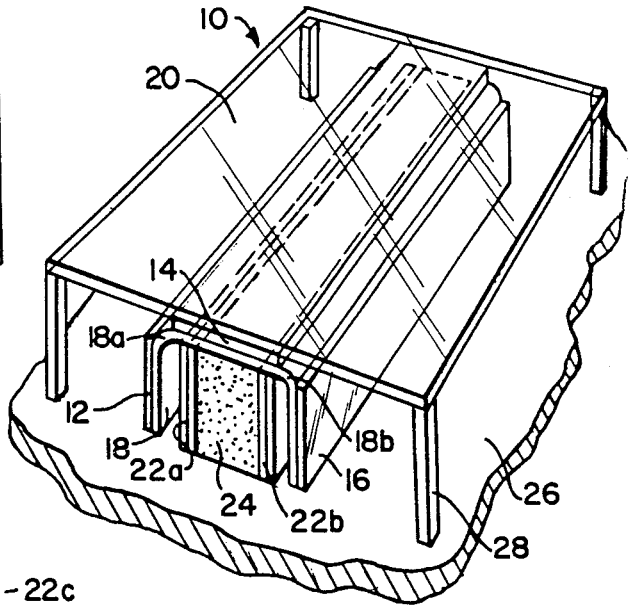
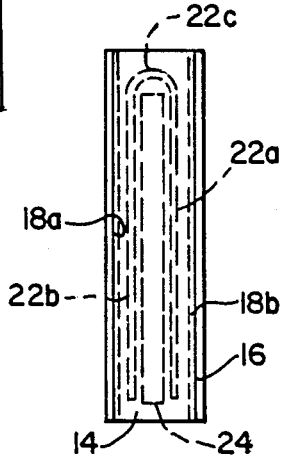
FIG. 3
FIG. 4A
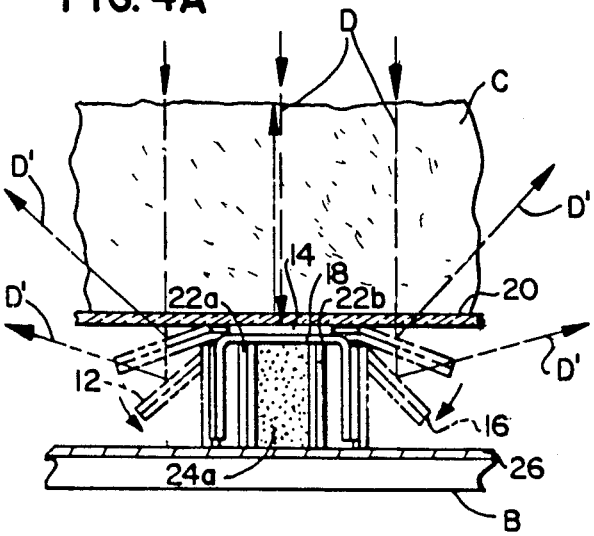
FIG. 4B
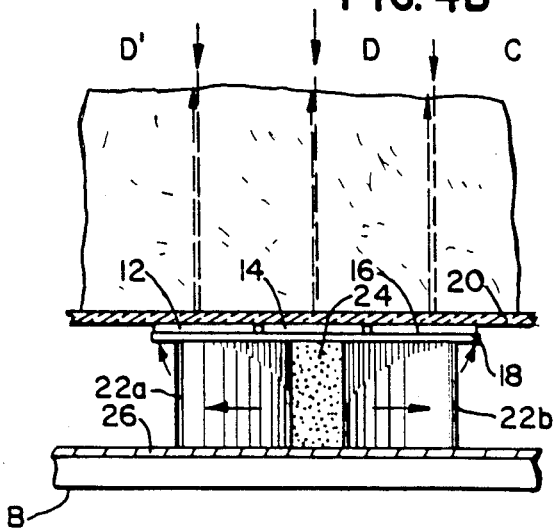

FIG. 5A
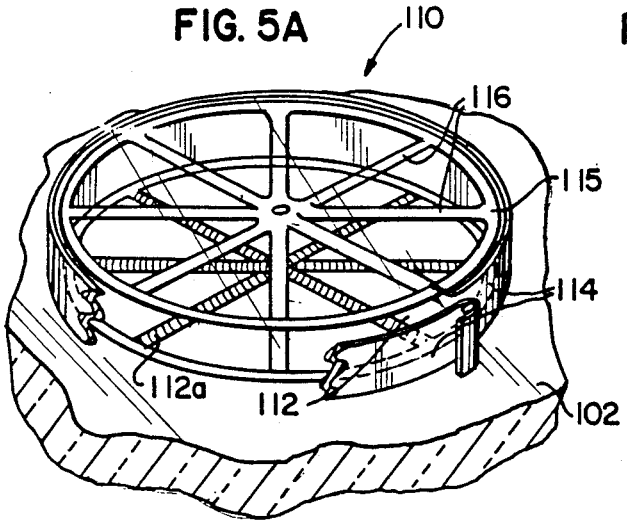
FIG. 5B
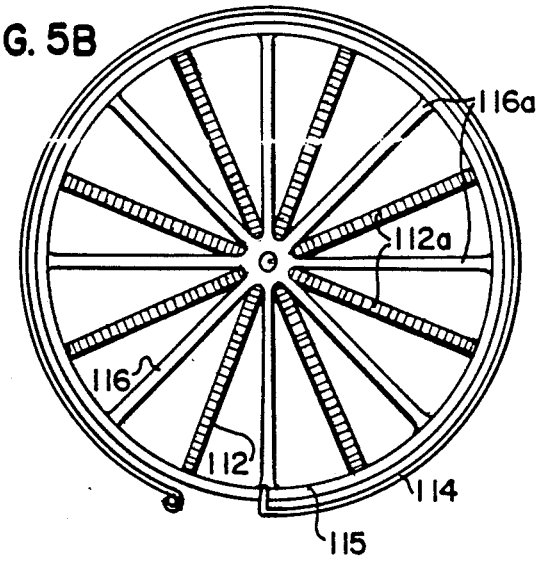
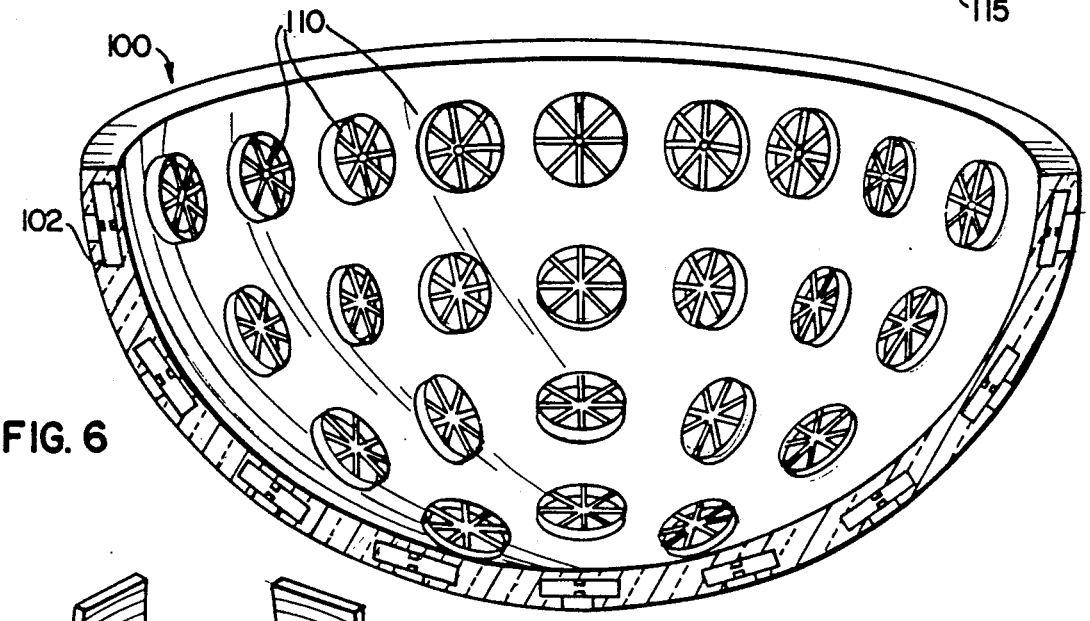
FIG. 6
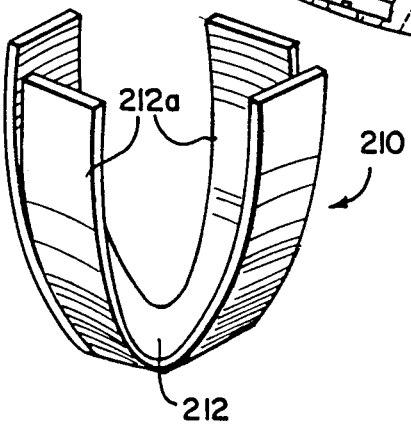
FIG. 7A
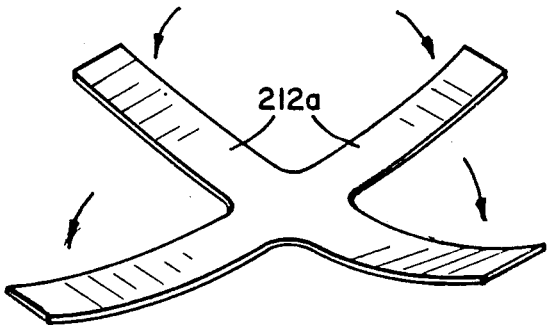
FIG. 7B

APPARATUS FOR PROMOTING THE UNIFORM HEATING OF A FOOD PRODUCT IN A RADIANT ENERGY FIELD

CROSS-REFERENCE TO RELATED APPLICATION

This application is a continuation-in-part of U.S. Ser. No. 765,374 filed Aug. 14, 1985, now U.S. Pat. No. 4,683,362, the disclosure of which is incorporated herein by reference.

BACKGROUND OF THE INVENTION

This invention relates to improvements in the cooking of a food product in the presence of a radiant energy source and, more particularly to an apparatus for the uniform heating of a food product in a radiant energy field.

The use of radiant energy for cooking, particularly in connection with a microwave oven, has become widespread in recent years. An estimated 66% of the 88 million American households now have microwave ovens and, in the post World War II period, microwaves have been the fastest growing appliance tracked by the Association of Home Appliance Manufacturers. Microwave cooking has reached this level of popularity primarily because food can be heated quickly and conveniently without the fuss of a lengthy meal preparation. However, the energy in a microwave oven is not distributed equally throughout the cavity of the oven. This unequal distribution causes some areas in the oven to be warmer than others and, as a consequence, food in those areas becomes hotter resulting in significant temperature differences between portions of food or within a single portion of food.

Many attempts have been made to equalize heat in the food. For example, stirring helps, but there are many foods that cannot be stirred. Rearranging, or rotating, the food within the oven cavity could help, but the food generally must be moved often to cook even substantially uniformly, a procedure that greatly reduces the convenience aspect of microwave cooking.

Reflective cells, as in parent U.S. Ser. No. 765,374, provide movable reflectors for reflecting the microwaves. The reflectors are movable with variations in the response of a temperature sensor, so that the reflectors vary the direction of the reflected microwave relative to the food product and vary the concentration of the reflective microwaves incident on the food to promote uniform heating.

The simplified apparatus of the present invention provides certain desirable advantages not obtained, with the apparatus of parent U.S. Ser. No. 765,374, now U.S. Pat. No. 4,683,362. For example, the apparatus of the present invention can be used in connection with a conventional radiant energy source such as a microwave oven or in connection with a commercial conveyor belt system wherein the food product is placed on trays, formed by the apparatus, and the trays are thereafter passed through a radiant field. This application is useful in a commercial cooking environment such as an institution or in the production of precooked food products.

As in parent U.S. Ser. No. 765,374, now U.S. Pat. No. 4,683,362, the collectors can be formed from a bimetallic material. The bimetallic material will fluctuate in relation to heating and cooling and vary the energy field radiating from the apparatus to promote uniform heating of the food product.

SUMMARY OF THE INVENTION

The present invention provides a simplified apparatus that, in the presence of a radiant energy heating source, will collect the radiant energy incident on the collectors and distribute a distinct radiant energy field to promote the heating of a food product. The simplified apparatus includes a plurality of collectors arranged on a base wherein each collector is formed from a number of tabs extending at an angle relative to the base. The base and the collectors are enclosed in a radiant energy transparent encasing structure to protect the collectors and to provide a convenient method of handling the apparatus. For example, the encasing structure can be in the form of a tray having segmented compartments.

The size of the collectors and the number of the tabs can vary to accommodate the volume of the food product prepared as well as to vary the desired temperature at which the food product is heated. The collectors can be formed from a bimetallic material such that the angular position of the tabs will fluctuate upwardly and downwardly with the respective heating and cooling of the bimetallic material. This fluctuation will correspondingly vary the energy field that is distributed by the apparatus.

In one embodiment a single base having a plurality of collectors is enclosed in the radiant energy transparent encasing structure. In another embodiment a second base or plate is positioned above the first base within the encasing structure such that the collectors of the second base are opposed to the collectors of the first base. A food product, placed on the apparatus, will interact with the energy field radiating from the apparatus to heat the food product to a uniform temperature.

Although the simplified apparatus of the present invention may be used in connection with a conventional radiant energy heating oven any source of radiant energy heating, such as that used in connection with a commercial conveyor belt system, may be substituted. A modified radiant energy encasing structure will allow the apparatus to be mounted on or in the cavity of an oven having a radiant energy heating source. In this instance, the energy field radiating from the apparatus will change the character of the oven such that large portions of food product will heat the food product to a uniform temperature throughout.

BRIEF DESCRIPTION OF THE DRAWINGS

FIG. 1 is a perspective view of the cells of the invention of parent application U.S. Ser. No. 765,374 illustrating a microwave oven within which an embodiment of the reflective cells of the parent application are installed;

FIG. 2 is an enlarged perspective view of one of the cells in FIG. 1, illustrating microwave reflecting elements movable by a bimetallic element;

FIG. 3 is plan view of the cell of FIG. 2 illustrating the U-shape of the bimetallic element;

FIG. 4A is an end view, partially in section, of the cell of FIG. 2, illustrating the pivotal motion of the reflectors and changing direction of the microwaves reflected as a result of the motion;

FIG. 4B is a view similar to FIG. 4A illustrating the reflectors fully pivoted into a horizontal coplanar configuration;

FIG. 5A is a perspective view of a modified embodiment of a cell according to the invention for incorporation into a food container, illustrating a bimetallic coil carrying microwave reflective element;

FIG. 5B is a plan view of a cell of FIG. 5A illustrating the rotated position of the reflective elements with unwinding of the heated coil;

FIG. 6 is a perspective view, partially in section, of a bowl, illustrating a plurality of cells of FIG. 5A incorporated into the wall of the bowl;

FIG. 7A is a modified embodiment of a reflective cell for incorporation into a food container, illustrating the cool condition of a bimetallic element having four arms in cone-like configuration;

FIG. 7B is a perspective view of the heated condition of the bimetallic element of FIG. 7A in which the arms are spread outwardly into a generally planar configuration to reflect the bulk of the microwaves directed at the element.

DESCRIPTION OF THE PREFERRED EMBODIMENTS

Figure 8:
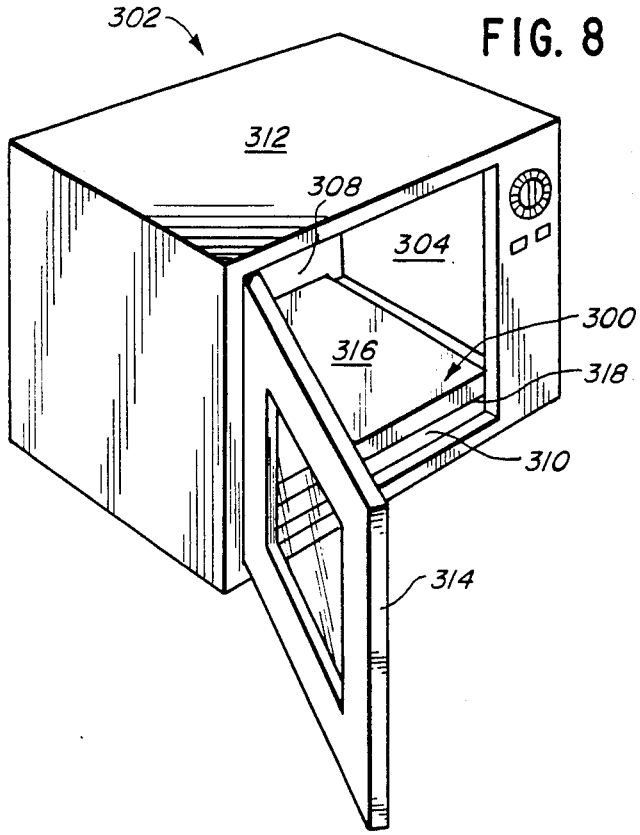
FIG. 8 is a perspective view illustrating the simplified apparatus of the present invention mounted on the floor of the cavity of the radiant energy heating oven.

FIGS. 17B are illustrative of embodiments disclosed in parent application U.S. Ser. No. 765,374, now U.S. Pat. No. 4,683,362.

Referring to FIG. 1, a plurality of reflective cells in an embodiment of the invention, are generally designated by reference character 10 and installed within a conventional microwave oven generally designated by reference character A. The cells 10 can be arranged in rectilinear rows in whicn the cells are spaced at least 1/16 inch in order to prevent arcing between the cells 10. Preferably, the rows of cells 10 cover substantially the entire bottom wall B of the oven A and the cells are elevated at a distance, for example ¾ to 1 inch above the wall B. In this embodiment, the food to be cooked is placed above the cells 10 as more fully described hereinafter.

Referring to FIGS. 2 and 4A, each cell 1 includes three reflectors 12, 14 and 16 formed by strips of aluminum or similar material which reflects microwaves. The reflectors 12, 14 and 16 are bonded to a flexible rubber sheet 18. The reflectors 12, 14 and 16 are spaced approximately 1/16 to ⅛ inch in side-by-side parallel arrangement. The middle reflector 14 is attached to a lower surface of a fixed plate 20 of plastic or similar material which is transparent to microwaves. This central reflector 14 is held horizontally stationary by the plate 20 which preferably extends to support the central reflector in all of the cells 10. The sheet 18 provides flexible hinging between the reflector 14 and each of the other reflectors 12 and 16, which allows the reflectors 12 and 16 to pivot in relation to the fixed central reflector 14. The reflectors 12 and 16 pivot about respective portions 18A and 18B of the sheet 18 narrowly separating the reflectors 12 and 16 from the fixed reflector 14. As shown in FIG. 2, when the oven A is not in operation, the reflectors 12 and 16 are pulled by gravity to extend in generally vertical parallel planes below the plane of the horizontally oriented reflector 14. In this configuration, the reflectors 12 and 16 face one another in spaced opposition. Between the vertically oriented reflectors 12 and 16, a U-shaped bimetallic element 22 is disposed so that the arms 22*a* and 22*b* of the U-shaped element 22 extend horizontally in generally spaced, parallel opposition between the reflectors 12 and 16, when the oven A is not in operation and the element 22 is in generally "cold" condition. Any conventional bimetallic element, for example copper-aluminum, can be employed in suitably fabricated, U-shaped configuration. The arms 22*a* and 22*b* can be dimensioned, for example, approximately ¾ inch in length and extend horizontally parallel and below the horizontal plane of the reflector 14. Between the arms 22*a* and 22*b*, a bar 24 of ferrite or similar material which readily absorbs microwaves is positioned to heat the element 22.

Referring to FIG. 3, the bight portion 22*c* of the element 22 is attached to the sheet 18 below the stationary reflector 14 so that the bight 22*c* is fixed while allowing the arms 22*a* and 22*b* to freely move horizontally between the positions illustrated in FIGS. 2 and 4B. The bar 24 is stationary and can be attached to the bottom surface of sheet 18 below the central reflector 14. As shown in FIG. 2, the cells 10 have a floor 26 of plastic or similar material which is transparent to microwaves and both the bight 22*c* and the bar 24 can be alternatively fixed to the upper surface of the floor 26. Plastic columns 28 separate the plate 20 from the rloor 26. The central reflector 14 shields the bar 24 from microwaves directly transmitted from the generator so that the bar 24 does not overheat.

Referring to FIG. 4A, a relatively large portion of food C is placed within the oven A above the plate 20 and will extend over a plurality of the cells 10, which are in the range 1–2 inches long. When the oven A is operated, the conventional microwave generator (not shown) directs microwaves represented by arrows D downward through the food C which absorbs some of the microwaves while other microwaves pass through the food C and are reflected upward by impingement against the central reflector 14 or the bottom wall B of the oven.

Additionally, the microwave generator directs some of the microwaves angularly against the sidewalls of the oven A which reflects these microwaves (not shown for simplicity) angularly downward through the food. Thus, microwaves are reflected from the bottom wall B in both normal and angular directions. As a result of numerous angularly reflected microwaves, the bar 24 will absorb microwaves and begin to generate heat. The heat generated by the bar 24 is conducted to the bimetallic element 22. As the element 22 heats, the arms 22*a* and 22*b* move apart or spread horizontally and force the respectively engaged reflectors 12 and 16 to pivot upwardly into the sequential phantom positions shown in FIG. 4A. As a result of the pivotal motion of the reflectors 12 and 16, some of the microwaves D which pass through the food C and the plate 20 will impinge on and reflect from the reflectors 12 and 16 at progressively different and decreasing angles as shown by the reflected microwaves D'. The reflected microwaves D' pass through the food C at angles which change with the pivotal movement of the reflectors 12 and 16 and thus, traverse different paths through the food C as the pivotal motion progresses.

Referring to FIG. 4B, once the arms 22*a* and 22*b* have fully spread and forced the reflectors 12 and 16 into the horizontal coplanar position, the reflectors 12 and 16 will engage the lower surface of the plate 20 which is generally cooled by food which has only begun to heat. The reflectors 12 and 16 are thus cooled by the plate 20 resulting in cooling of the arms 22*a* and 22*b* which remain in respective engagement with the cooled reflectors 12 and 16. As the arms 22*a* and 22*b* cool, they retract inwardly toward one another allowing the respective reflectors 12 and 16 to pivot downwardly in the reverse paths of motion illustrated in FIG. 4A. Thus, after temporarily reaching the coplanar positions shown in FIG. 4B in which the reflected microwaves D' are directed upward and generally coincident with the impinging microwave D, the downwardly pivoting reflectors 12 and 16 will again reflect microwaves at progressively increasing angles in reverse of the progression shown in FIG. 4A. However, since the bar 24 continues to heat, the arms 22*a* and 22*b* become increasingly heated as they retract and will once again spread forcing the repeated upward pivot of the reflectors 12 and 16. As a result of the cycled, upward and downward pivotal motion of the reflectors 12 and 16, the microwaves reflected therefrom will also be directed at cycled, increasing and decreasing angles so that the food C is subjected to a changing gradient in concentration of microwaves D'. This changing gradient prevents absorption of microwaves at fixed concentrations in the various strata within the food, and thus eliminates creation of "hot spots". The effect of the cycled change in the direction of reflected microwaves D' in FIG. 4A will be multiplied by the microwaves initially directed by the generator against the sidewalls of the oven which are reflected therefrom to impringe the reflectors 12 and 16 and thus, are subjected to the similar change in reflected angles.

Each cell 10 operates independently of the other cells. The combined effect of the action of the cells is an upward shifting in the focus of microwave concentration (referred to as the power curve) in the design of the oven, as well as a multiplicity of motions redirecting reflected microwaves, both of which are particularly beneficial in microwave cooking of large or thick portions of food.

In modified embodiments, the cells can be incorporated into containers for cooking food, for example, a bowl. Referring to FIG. 6, a bowl generally designated by reference character 100 has a wall 102 within which are embedded a plurality of cells generally designated by a reference character 110. The wall 102 is plastic or similar material transparent to microwaves. Referring to FIG. 5A, the cell 110 includes a stationary generally circular configuration of diametrically intersecting rods 112 of aluminum or similar material which reflects microwaves. As best shown in FIG. 5B, the rods 112 form a pattern of eight radial projections, however the number of projections may be variable and is dependent upon maintaining a distance between the peripheral ends 112*a* less than approximately ½ inch, and therefore, fewer or greater than eight radial projections may be required depending upon the length of the rods 112 and the size of the cell 110. Each cell 110 further includes a generally circular, bimetallic coil 114 which circumscribes and is connected to a wheel 115 on which the ends of eight (8) diametrical spokes 116 are attached. The spokes 116 intersect coaxially with the intersection of the rods 112, and the coil 114 is dimensioned so that in its "cold" condition the spokes 116 are superimposed on rods 112 in congruent manner. The spokes 116 are also made of aluminum or similar material which reflects microwaves.

Referring to FIGS. 5B and 6, when the bowl 110 containing food product (not shown) is placed in a microwave oven and cooking is begun, the food heats and conducts heat to the coil 114. As best shown in FIG. 5B, the heated coil 114 expands in an unwinding motion so that spokes 116 are rotated from the superimposed position of FIG. 5A to the position of FIG. 5B in which the spokes 116 generally bisect the angles between the radial projections of the rods 112. In this position, the adjacent ends 112*a* and 116*a* of the respective rods 112 and spokes 116 will be at a distance of approximately ¼ inch. The microwaves typically have a wavelength less than ¼ inch and the configuration of alternating rods 112 and spokes 116 effectively reflects the bulk of the microwaves directed at the cell 110. Particularly when the food is very cold or frozen, the peripheral area of the food can become heated and thus heat the coil of a particular cell 110, even though the interior of the food may temporarily remain cool or frozen. As a result, the peripheral area which heats the coil 114 can cool again by contact with flowing liquid produced in the heating process or by simple heat transfer to the remaining cool or frozen areas. Thus, the peripheral area of the food can again cool the coil 114 and reverse the rotation of the spokes 116 to approach their original position as shown in FIG. 5A, which again allows the microwaves to pass through the cell 110. The unwinding and winding of the coil 114 is thus dependent upon the heating and cooling of the peripheral area of the food in which a particular cell 110 is in contact. The combined effect of the coil motion in the plurality of cells 110 produces changing concentration of the microwave reflection passing through various strata within the food to promote uniform heating.

Referring to FIG. 7A, a reflective cell 210 is a modified embodiment of a cell for incorporation into the wall of a bowl or similar food heating container. The cell 210 includes a bimetallic element 212 which has four arms 212*a* which are bent from their central intersection to form a cone-like cruciform. The bimetallic element 212 can be stamped and bent into the cone-like configuration of FIG. 7A, and then incorporated into the wall of a container similar to the bowl in FIG. 6. Referring to FIG. 7B, when the microwave oven is operated and cooking is begun, the heated periphery of the food (not shown) heats the element 212 causing the arms 212*a* to spread outwardly into a generally planar configuration in which the arms 212*a* intercept and reflect the bulk of the microwaves directed at the cell 210. When the periphery of food products cools, the arms 212*a* will again fold inward to the cone-like configuration of FIG. 7A, followed by reheating into the configuration of FIG. 7B. In this embodiment, the element 212 serves as both the bimetallic element and the reflector.

The combined motions of the cells 210 promote uniform heating of the food by changing the concentration of microwave reflection passing through various strata within the food.

The improvements of the present invention now will be discussed with reference to FIGS. 8–18B.

Referring to FIG. 8, one embodiment of the simplified apparatus of the present invention is designated generally by the reference numeral 300 and is shown installed within a conventional microwave oven, designated generally by the reference numeral 302. The oven 302 has walls, for example 304 and 308 and a floor 310. A housing 312 has an access door 314 through which to gain access to the interior of the oven 302.

As an example of the unique ability of the apparatus 300 of the present invention to uniformly heat a food product, a cake was prepared in an conventional microwave oven such as the oven 302 wherein the apparatus 300 was placed on the floor 310 of the oven 302. The cake batter was prepared from a prepackaged cake mix according to the directions on the package. A sheet of wax paper was placed on the bottom of a 12 inch square plastic cake pan before the cake batter was put in the cake pan. A sheet of plastic wrap was placed over the pan and slits were cut in the plastic wrap to allow steam to escape from the covered cake pan. After approximately 8.5 minutes on a high setting the cake had uniformly risen and uniformly cooked. Even though the cake was inadvertently tilted as it was removed from the oven, it cooled to form a cake with excellent uniformity and texture.

In another example, a 4.3 pound whole chicken was wrapped in a sheet of plastic wrap and centered on a tray formed by the apparatus 300. The apparatus 300 was placed on the floor 310 of the oven 302 and the chicken was heated for twenty-seven minutes at a high setting (750 watts). The chicken was uniformly cooked at that time without moving or turning of the chicken. The wrap was removed at about thirteen minutes to allow the chicken to brown. Further, the wing of the chicken, generally requiring protection from over cooking, emerged as tender and juicy as the remainder of the chicken.

The most striking example is the ability of the apparatus 300 to promote the uniform cooking of eggs in the presence of a radiant energy heating source. In a normal microwave oven such as the oven 302, eggs will cook unevenly resulting in an unappealing inconsistency in taste, texture, and appearance. Under the influence of the energy field radiated by the apparatus 300, however, the eggs are uniformly cooked with a remarkable balance of doneness between eggs when several eggs are prepared at the same time.

Figure 9:
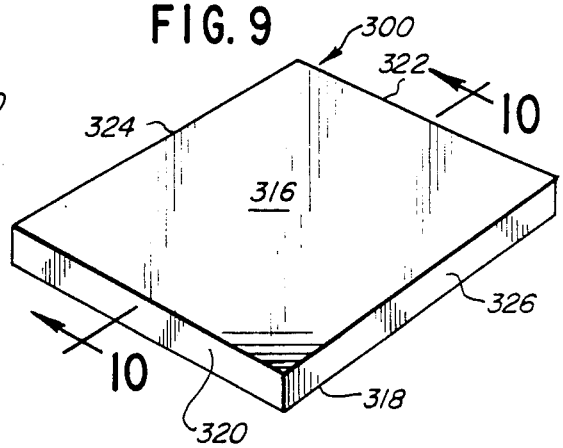
FIG. 9 is a perspective view of the simplified apparatus of the present invention.

Referring to FIG. 9 the apparatus 300 is illustrated in a perspective view wherein an upper surface 316, a lower surface 318, and walls 320, 322, 324, and 326 are more clearly seen. The apparatus 300 is not restricted to a particular shape or dimension so long as it conforms to the limitations discussed below. However, the apparatus 300 can be sized such that it can be placed on the floor 310 of the oven 302 when needed and conveniently removed from the oven 302 through the door 314 when not needed. Additionally, when the apparatus 300 is configured with a relatively flat upper surface 316 and a relatively flat lower surface 318, the apparatus 300 will sit on the floor 310 of the oven 302 such that a food container (not shown) can be placed directly on the upper surface 316.

Some glass cooking trays and containers are formed including a metallic material. It has been found that these trays and containers can interfere with the efficiency of the apparatus 300. Generally, any plastic container designed for microwave utilization can be used in conjunction with the apparatus 300.

Where a smaller microwave oven is used, the food product or container must not be so large that it touches the walls of the oven 302, because that will interfere with the apparatus' efficiency to cause uneven cooking. It has been found that a distance of approximately 1½ inches from the walls or from the door 314 is sufficient to prevent interference with the efficiency of the apparatus 300.

The first embodiment of the present invention will be discussed in greater detail with reference to FIGS. 10 and 11. A base 328 having an upper surface 330 (best seen in FIG. 10) has a plurality of collectors 334 formed therein. Each of the collectors 334 has a periphery 336 located on the base 328 and a radiant energy transparent region 338 within the periphery 336. The collectors 334 further include a plurality of tabs 340 located along the periphery 336 and extending upwardly from the base 328 over the region 338.

Figure 10:
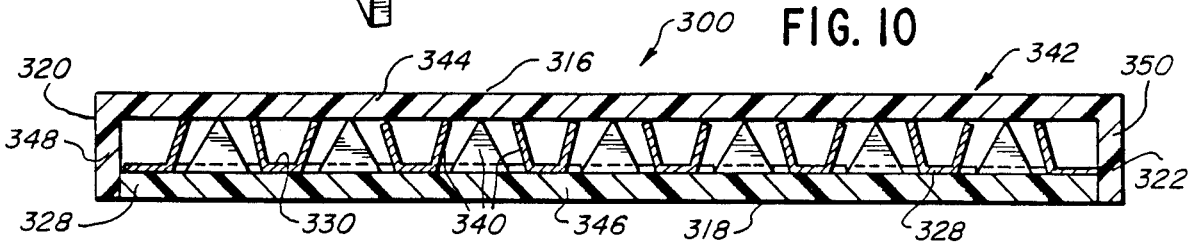
FIG. 10 is a side sectional view of the apparatus of FIG. 9 taken along the line 10—10 therein.
Figure 11:
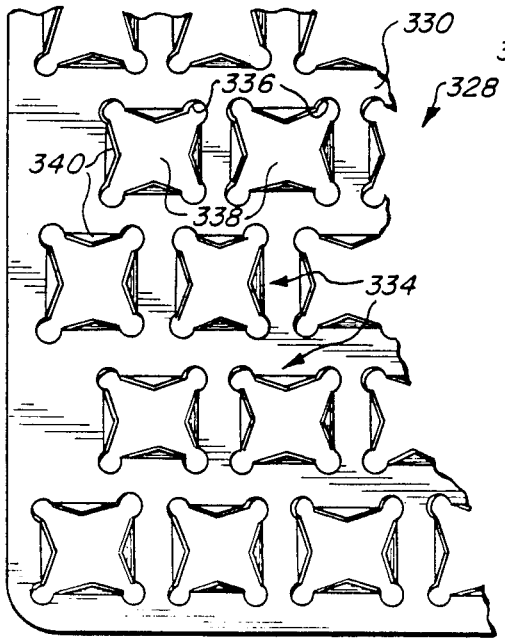
FIG. 11 is a partial top plan view of a base illustrating several collectors each having a plurality of tabs cut from the base and angled upwardly from the base.

As seen in FIG. 10, the tabs 340 extend upwardly from the base 328 at an angle of 80–90 degrees relative to the region 338. It is believed that the collectors 334 collect the radiant energy incident on the collectors 334 and redistribute that energy in a distinct energy field to resistively couple with the food product being heated. As the food product heats the energy field will shift to the unheated portion of the food product, thus promoting uniform heating.

The angle of the tabs 340 determine the strength of the field distributed by the collectors 334. It has been found that when the angle of the tabs 340 relative to the region 338 is less than 80 degrees the strength of the field distributed by the collectors 334 is diminished. As the angle is further decreased the strength of the field correspondingly decreases. Therefore, although the apparatus 300 of the present invention will function at other angles, a range of 80–90 degrees has been found to most efficiently promote the uniform heating of a food product.

Figure 16:
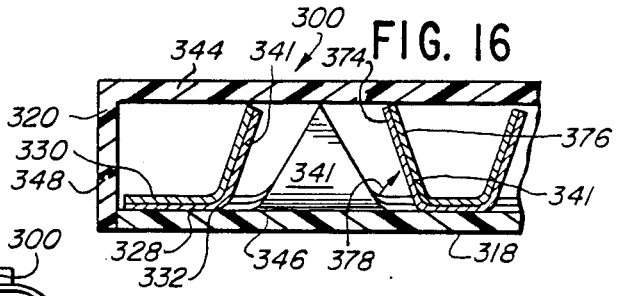
FIG. 16 is a partial side sectional view of a single collector illustrating the bimetallic tabs.

The collectors 334 are formed from a radiant energy reflective material. As will be explained, the material can be a bimetallic material wherein the angle of tabs 341 (as seen in FIG. 16) relative to the base 328 will fluctuate as the bimetallic tabs 341 first heat and then cool thus causing the field of energy distributed by the collectors 334 to correspondingly fluctuate.

Alternatively, the material can be aluminum or a similar material which will reflect the radiant energy incident on the collectors 334. Where the radiant energy reflective material is aluminum, it has been found that a thickness of 0.007 to 0.008 inches provides sufficient stability to form the tabs 340 while keeping the overall weight of the apparatus 300 at a minimum.

An encasing structure 342 (FIG. 10) has an upper wall 344, a lower wall 346, and sidewalls 348 and 350. The encasing structure 342 is utilized to protect the collectors 334 and to prevent them from being damaged either by handling or by the food product. So as not to interfere with the efficiency of the collectors, the encasing structure 342 is formed from a radiant energy transparent material such as a high temperature thermo-plastic. The encasing structure 342 is not restricted to a specific size or shape so long as it functions to encase and to protect the collectors 334 and the base 328. In fact, as will be discussed in connection with FIG. 14, the encasing structure 342 can have a tray configuration. However, it has been found that the upper surface 316 of the encasing structure 342 should be positioned such that the food product is held at least approximately ⅜ to ¾ inch away from the collectors 334 to prevent interference with the field distributed by the collectors 334.

Referring again to FIG. 11, the collectors 334 have four triangularly shaped tabs 340 located along the periphery 336. In this instance, the periphery 336 has the general shape of a square. It is also contemplated that the periphery 336 of the collectors 334 can form a circle or a hexagon. In fact, tests have shown that the most efficient shape for utilization with a small volume food product is a grouping of collectors 334 having the periphery 336 in alternating square and circular shapes.

Figure 12:
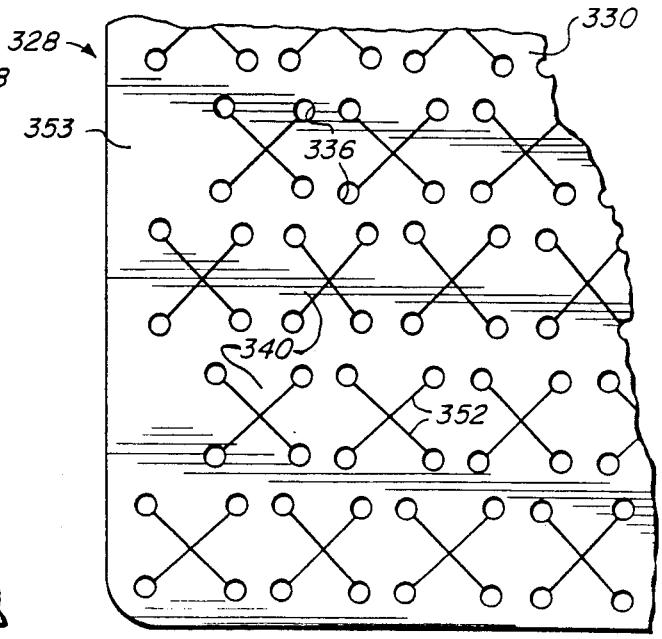
FIG. 12 is a partial top plan view of the base of FIG. 11 as seen before tabs are angled upwardly from the base.
Figure 18A:
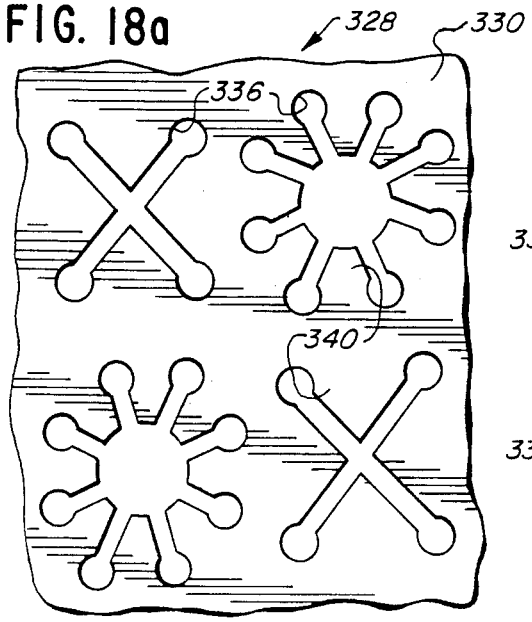
FIG. 18A is a top plan view of the base of the present invention il1ustrating the collectors having an alternating square and circular shape with the tabs cut from the base.
Figure 18B:
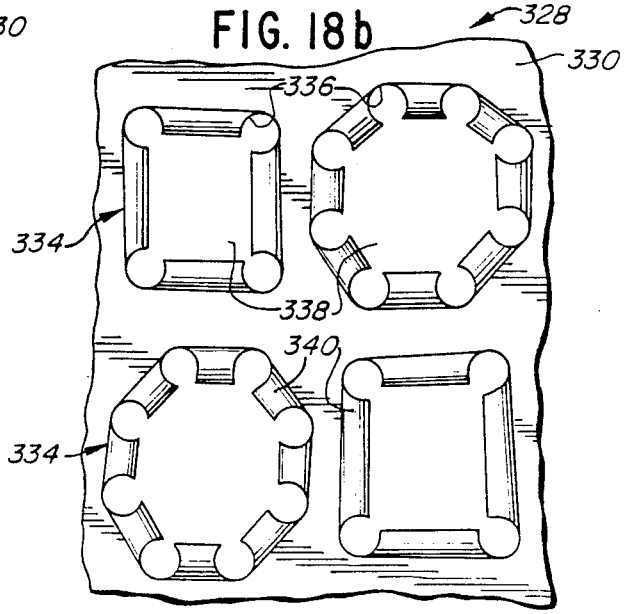
FIG. 18B is a top plan view of the base shown in FIG. 18A illustrated with the tabs angled upwardly from the base.

The number and shape of the tabs 340 can vary with the size of the collectors 334 and the shape of the periphery 336. For example, as seen in FIGS. 11 and 12, the collectors 334 can have a periphery 336 in the shape of a square and have four tabs 340 each of which is in the shape of a triangle or, as seen in FIGS. 18A and 18B, the collectors can have multiple tabs 340 each of which is essentially in the shape of a truncated triangle. The tabs 340, however, must be spaced apart one from another, a distance sufficient to prevent arcing in the presence of the radiant energy.

The collectors 334 can be coated with an insulating material such as silicone to further prevent arcing in the presence of the radiant energy. Other insulating materials can be substituted so long as they do not interfere with the field distributed by the collectors 334. The coating can be applied to the collectors 334 as well as to the base 328, but must at least coat the tabs 340 to effectively prevent arcing in the presence of radiant energy.

The size of the collectors 334 are related to the wave length of interest. For example, the collectors 334 with the periphery 336 having an approximate diameter of one inch can be used for a small volume food product. A larger diameter of approximately two and ⅜ inches is appropriate for a larger volume food product where a larger reflective field is necessary. Also, the collectors 334 having the periphery 336 of different diameters can be incorporated into the single apparatus 300.

The following tests demonstrate the effect of the size of the collectors 334 on a small volume food product. The tests were performed utilizing a 12 inch by 12 inch plastic tray-shaped apparatus 300 and a conventional consumer microwave oven set at high (750 watts). Eggs were chosen as a small volume test food. A subjective quality rating, based on a scale of one to ten, was chosen to indicate the texture, taste, and appearance of the eggs prepared using the apparatus 300 as compared to eggs prepared using a conventional non-microwave cooking range. The approximate dimensions of the periphery 336 of the collectors 334 were as follows:

round—one and ½ inches in diameter
square—one inch on a side
large round—two and ⅜ inches in diameter

| | | | |
|---|---|---|---|
| I. | 45 Round Collectors Over 50 Round Collectors | A. | One egg - 35 seconds Cooked Medium-light (very even) Quality 9 |
| | | B. | Two eggs - 55 seconds Cooked Medium - Medium light Quality 7 (balance of doneness comparitively was very good) |
| II. | 45 Round Collectors Over Round - 28 Square - 27 | A. | One egg - 35 seconds Cooked Medium-light Quality 7 |
| | | B. | Two eggs - 55 seconds Cooked Medium - Medium light Quality 5 |
| III. | 45 Round Collectors Over 60 Square Collectors | A. | One egg - 35 seconds Cooked incomplete Quality N/A |
| | | B. | One egg - 40 seconds Cooked Medium-light Quality 8 |
| | | C. | Two eggs - 55 seconds Cooked incomplete Quality N/A |
| IV. | None Over Round - 28 Square - 27 | A. | One egg - 35 seconds Cooked Medium light Quality 9 |
| | | B. | Two eggs - 55 seconds Cooked Medium - Medium light Quality 7 |
| V. | None Over 60 Square Collectors | A. | One egg - 35 seconds Cooked Medium-light Quality 8 |
| | | B. | Two eggs - 55 seconds Cooked Medium - Medium-light Quality 5 (Cooked well individually no balance between eggs) |
| VI. | 13 Large Round Collectors Over None | A. | One egg - 35 seconds Cooked Medium-light Quality 9 (very good) |
| | | B. | Two eggs - 55 seconds Cooked Medium - Medium-light Quality 7 (explosion - need more large collectors) |
| VII. | 13 Large Round Collectors Over None | A. | One egg - egg no good Cooked uneven Quality none |
| | | B. | Two eggs - Same as A (insufficient collectors to carry and maintain field load) |

The above date indicates that the smaller collectors 334 will produce a good quality rating for a small volume food product such as eggs. However, where the large collectors were utilized, they were unable to create and maintain a radiant energy field to resistively couple with the eggs.

The base 328 can be a radiant energy reflective material, such as aluminum, from which the tabs 340 have been cut, formed, and angled out of the base plane. In this case, the amount of radiant energy reflected by the base 328 is directly related to the amount of material within the periphery 336 that has been removed in the process of forming the tabs 340 and to the number of collectors 334 formed on the base 328. Therefore, the collectors 334 should be spaced one from another such that the ratio of the exposed material of the base 328 compared to the area within the periphery 336 is sufficiently reduced to avoid excess interference from the radiant energy reflected by the upper surface 330 of the base 328 while not effecting the structural integrity of the base 328. For example, tests have shown that a 0.007 to 0.008 inch aluminum base 328 having the collectors 334 with the one inch diameter periphery 336 alternating in shape between square and circular should be spaced apart at a distance of ⅛ to 1/16 inch to reduce interference from the radiant energy reflected by the upper surface 330 of the base 328.

The simplified apparatus 300 can be conveniently and inexpensively manufactured from a single sheet of radiant energy reflective material 353. Referring to FIG. 12, the outer periphery 336 is located on the sheet 353 and the collectors 334 are scored and cut. The tabs 340 are cut such that tabs 340 remain affixed to the outer periphery 336 of the base 328. The tabs 340 can be either cut or stamped from the base 328 but the edges 352 of the tabs 340 must be relatively cleanly cut so as not to interfere with the radiant energy field of the collectors 334. In the example illustrated in FIG. 12, the tabs 340 are in the shape of a triangle and, for this example, will require no further forming. The tabs 340 are bent out of plane from the base 328 to form the region 338 therebeneath. The tabs 340 are positioned at an angle of less than 90 degrees relative to the region 338 to form the collectors 334. Referring to the circular shape collectors 334 (seen in FIGS. 18A and 18B), the tabs 340 can be cut to the desired shape either with the original stamping or shaped subsequent to stamping. The collectors 334 can also alternate on a single sheet. For example, as seen in FIGS. 18A and 18B, the collectors 334 can alternate between those having a circular or a square periphery 336. Additionally, the collectors 334 can be supplied with a protective coating of an insulting material such a silicone. Finally, the base 328 and the collectors 334 are enclosed in an appropriate radiant energy transparent encasing structure.

Figure 13:
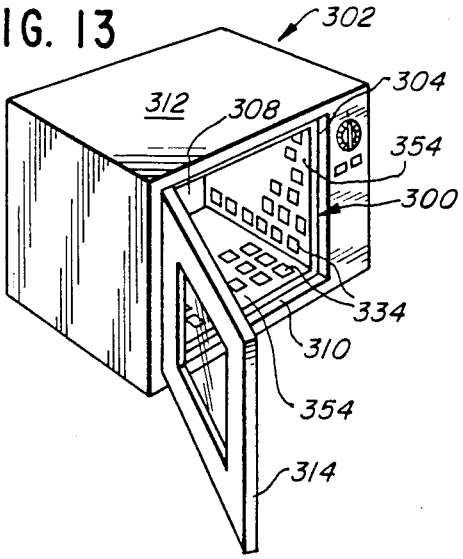
FIG. 13 is a perspective view illustrating the simplified apparatus of the present invention mounted on the walls of the cavity of the radiant energy heating oven.

Referring to FIG. 13, the apparatus 300 can be provided with a modified encasing structure 354 such that the apparatus 300 can be mounted on or in one or more of the walls 304, 308 or the floor 310 of the microwave oven 302. In this case, it has been found that the collectors 334 having a larger diameter are best suited to be mounted on or in the walls because they provide a larger reflective field needed to uniformly heat a food product when it is located at a distance from the apparatus 300. When the apparatus 300 is mounted on or in the floor 310 of the microwave oven 302, both small and large diameter collectors 334 can be incorporated into a single apparatus 300 to uniformly heat both small and large portions of the food product placed on the apparatus 300.

Figure 14:
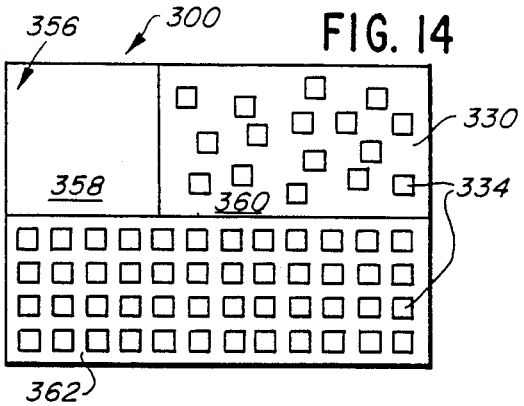
FIG. 14 is a top plan view illustrating the encasing structure of FIG. 10 as a segmented tray having a plurality of sections.

In FIG. 14, the apparatus 300 is shown having a tray shaped encasing structure 356. For illustrative purposes, the collectors 334 are visible through the tray shaped encasing structure 356. The structure 356 is further sectioned into compartments 358, 360 and 362. The collectors 334 are arranged on the base 330 such that each of the sectioned compartments 358, 360, and 362 vary in their ability to promote the heating of the food product. For example, the compartment 358 is shown having no collectors 334 and will, therefore, not promote the heating of the food product placed on that compartment. The compartment 360 is shown having the collectors 334 spaced relatively far apart such that the heating of the food product placed on that compartment is slightly promoted. The compartment 362 is shown having the collectors 334 tightly grouped such that the heating of the food product placed on that compartment is greatly promoted. The relative ability of each of the compartments 358, 360, and 362 could also be varied by varying the shape or size of the collectors 334 beneath that compartment such as by providing the smaller diameter collectors 334 for a smaller food product and by providing the larger diameter collectors 334 for a larger food product.

The compartments 358, 360, and 362 can be provided with identifiers, such as color, for readily identifying the relative ability of each of the compartments 358, 360, and 362 to promote the heating of the food product. In the example illustrated by FIG. 14, the compartment 358 could be identified by a cool color such as white or light blue, the compartment 360 could be identified by a warm color such as pink, and the compartment 362 could be identified by a hot color, such as red.

Figure 15:
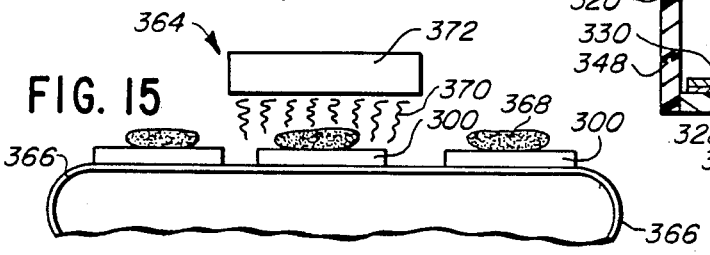
FIG. 15 is a schematic illustrating the apparatus of the present invention in conjunction with a commercial conveyor belt system.

The apparatus 300 is not restricted to use with the conventional microwave oven 302, illustrated in FIGS. 8 and 13. In FIG. 15, the apparatus 300 is illustrated in conjunction with one example of a commercial conveyor belt system generally designated 364 having a conveyor belt 366. The apparatus 300 with a food product 368 thereon is placed on the conveyor belt 366. As the conveyor belt 366 carries the apparatus 300 through a radiant energy field 370 produced by a radiant energy source 372 the plurality of collectors 334 collect the radiant energy from the radiant energy field 370 that is incident on the collectors 334 and redistribute that energy in a distinct energy field to promote the heating of the food product 368. It can be seen that the apparatus 300 having the tray shaped encasing structure 356, illustrated in FIG. 14, is particularly advantageous for use with the commercial conveyor belt system 364 illustrated in FIG. 15. An entire meal having several of the food portions 368 each requiring a separate degree of heating can be prepared with one exposure to the radiant energy field 370.

FIG. 16 illustrates one example of bimetallic tabs 341 having two bimetallic layers 374 and 376. In general, when a solid is heated, it expands. However, all substances do not expand alike. Some metals, like aluminum, expand up to twice as much as others. In the bimetallic tabs 341, two layers of different metals, are bonded together. When heated, one metal expands more than the other, causing the tabs 341 to bend. The hotter the tabs 341 become the more it will bend. When the tabs 341 cool down to the original temperature, the tabs 341 become straight again. This differential expansion is applied to the tabs 341 of the collectors 334 to effect a fluctuation of the angle between the tabs 341 and the region 338, indicated by an arrow 378. If the layer 376 is aluminum, the angle indicated by the arrow 376 will decrease as the tabs 341 are heated and then return to the original position as the tabs 341 cool. Further, the metal chosen for the layer 374 can differ according the relative thickness of the layers 374 and 376 to maintain the angle of the tabs 341 in the approximate range of 80°–90°.

Figure 17:
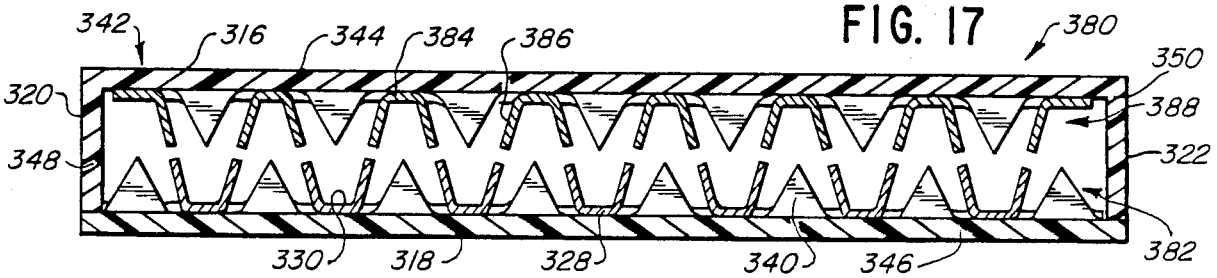
FIG. 17 is a partial side sectional view illustrating the opposed collectors of an alternative embodiment of the present invention.

Referring to FIG. 13, a second embodiment of the simplified apparatus of the present invention is designated generally by the reference numeral 380. In the apparatus 380, the base 328 having the plurality of radiant energy reflective tabs 340 thereon forms a first plurality of collectors 382. A second base or plate 384 having a second plurality of radiant energy reflective tabs 386 thereon forms a second plurality of collectors 388. The plate base 384 is seen to have tabs 386 extending downwardly therefrom such that the second plurality of collectors 388 is positioned opposed to the first plurality of collectors 382 within the encasing structure 342. Tests have shown that the first plurality of collectors 382 and the second plurality of collectors 388 cooperate most efficiently when they are positioned offset one from another as illustrated in FIG. 17.

Tests have further shown that the apparatus 380 is most efficient where the second plurality of collectors 388 are configured substantially in the shape of a square and the first plurality of collectors 382 are configured to alternate between substantially that of a square and substantially that of a circle.

The parameters and limitations discussed in reference to the apparatus 300 of the first embodiment are equally applicable to the apparatus 380 of the second embodiment. With reference to the apparatus 380, it is believed that the collectors 382 and 388 cooperate to more efficiently collect the radiant energy incident on the collectors 382 and 388 and to more efficiently redistribute that energy in a distinct energy field. This distinct energy field then will resistively couple with the food product to promote the uniform heating of the food product within the reflected field.

Modification and variation of the present invention are possible in light of the above teachings. The collectors 334, 382, and 388 can vary in both material and dimension according to the conditions under which the apparatus 300 or 380 is intended to function and the type and volume of the food product to be heated. It is therefore to be understood that within the scope of the appended claims, the invention may be practiced otherwise than as specifically described.

What is claimed and desired to be secured by Letters Patent of the United States is:

1. An apparatus for uniformly heating a food product in the presence of a radiant energy heating source comprising:

a base, said base having an upper surface;

a plurality of collectors of radiant energy reflective material, said collectors having a periphery located on said upper surface of said base and a substantially radiant energy transparent region within said periphery, said collectors further having a plurality of tabs located along said periphery and spaced apart from adjacent tabs to prevent arcing in the presence of radiant energy, said tabs inclined upwardly from said base over said transparent region at an angle of less than 90 degrees relative to said region; and a substantially radiant energy transparent encasing means enclosing said base and said plurality of collectors for promoting the uniform heating of the food product in the presence of the radiant energy heating source.

2. The apparatus as defined in claim 1 wherein said base is a radiant energy reflective material.

3. The apparatus as defined in claim 2 wherein said radiant energy reflective material is aluminum.

4. The apparatus as defined in claim 3 wherein said aluminum is approximately 0.007 to 0.008 inches in thickness.

5. The apparatus as defined in claim 1 wherein said base located within said periphery is removed to form said tabs.

6. The apparatus as defined in claim 1 wherein the shape of said periphery of said collectors is substantially that of a square.

7. The apparatus as defined in claim 1 wherein the shape of said periphery of said collectors is substantially that of a circle.

8. The apparatus as defined in claim 1 wherein the shape of said periphery of said collectors is substantially that of a hexagon.

9. The apparatus as defined in claim 1 wherein said angle of said tabs is approximately 80–90 degrees.

10. The apparatus as defined in claim 1 wherein said tabs are formed from a bimetallic material.

11. The apparatus as defined in claim 1, said collectors further coated with an insulating material to prevent arcing in the presence of radiant energy.

12. The apparatus as defined in claim 11 wherein said insulating material is silicone.

13. The apparatus as defined in claim 1 wherein said radiant energy encasing means is high temperature thermoplastic.

14. The apparatus as defined in claim 1 further providing that said radiant energy transparent encasing means is adapted for use in connection with a commercial conveyor belt system.

15. The apparatus as defined in claim 1 wherein said radiant energy transparent encasing means is adapted to form a tray such that said encasing means defines a plurality of sectioned compartments.

16. The apparatus as defined in claim 15 wherein said collectors are spaced apart within said tray such that said plurality of sectioned compartments vary in their ability to promote the uniform heating of the food product.

17. The apparatus as defined in claim 15 wherein said plurality of sectioned compartments are identified by color.

18. The apparatus as defined in claim 1 further including a plate having a lower surface;

a second plurality of collectors of radiant energy reflective material, said collectors having a periphery located on said lower surface of said plate and a substantially radiant energy transparent region within said periphery, said collectors further having a second plurality of tabs located along said periphery and spaced apart from adjacent tabs to prevent arcing in the presence of radiant energy, said tabs extending downwardly from said plate at an angle of less than 90 degrees relative to said region; and said radiant energy transparent encasing means enclosing said base and said plate such that said collectors on said base are positioned opposed to said collectors on said plate for promoting the uniform heating of said food product.

19. The apparatus as defined in claim 18 wherein said collectors on said base and said collectors on said plate are positioned offset one from another.

20. The apparatus as defined in claim 18 wherein the shape of said periphery of said collectors on said plate is substantially that of a circle and said periphery of said collectors on said base is alternately substantially that of a square and substantially that of a circle.

21. The apparatus as defined in claim 1 wherein the shape of said periphery of said plurality of collectors is alternately substantially that of a square and substantially that of a circle.

22. A method of manufacturing an apparatus for uniformly heating a food product in the presence of radiant energy heating source comprising:

locating a plurality of collectors on a surface of a base of radiant energy reflective material;

cutting a plurality of tabs from said base such that at least one side of said tab remains affixed to an outer periphery of said collectors;

bending each of said collector tabs out of plane from said base toward one another at an angle of less than 90 degrees relative to said base; and enclosing said base in a radiant energy transparent encasing means.

23. The method defined in claim 22 further including coating said collectors with an insulating material before encasing said base and said collectors in said radiant energy transparent encasing means.

24. The mothod defines in claim 23 wherein said insulating material is silicone.

25. The method defined in claim 22 wherein said radiant energy transparent encasing means is high temperature thermo-plastic.

26. An apparatus in combination with an oven for uniformly heating a food product in a radiant energy heating cavity of said oven, comprising:

said oven having a radiant energy heating cavity, said cavity having walls and a floor;

said apparatus having a base, said base having an upper surface;

a plurality of collectors of radiant energy reflective material, said collectors having a periphery located on said upper surface of said base and a substantially radiant energy transparent region within said periphery, said collectors further having a plurality of tabs located along said periphery and spaced apart from adjacent tabs to prevent arcing in the presence of radiant energy, said tabs inclined upwardly from said base over said transparent region at an angle of less than 90 degrees relative to said region; and a substantially radiant energy transparent encasing means enclosing said base and said plurality of collectors, said apparatus further adapted to engage said cavity of said oven for promoting the uniform heating of said food product in said oven.

27. The apparatus in combination with an oven as defined in claim 26 wherein said apparatus is located within said walls of said oven.

28. The apparatus in combination with an oven as defined in claim 26 wherein said apparatus is located within said floor of said oven.

* * * * *